US007121241B1

(12) United States Patent
Genise et al.

(10) Patent No.: US 7,121,241 B1
(45) Date of Patent: Oct. 17, 2006

(54) VALVE CONTROL SYSTEM INCLUDING DEACTIVATING ROCKER ARM

(75) Inventors: David G. Genise, Marshall, MI (US); Michael R. Gose, Marcellus, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/328,597

(22) Filed: Jan. 10, 2006

(51) Int. Cl.
*F01L 1/00* (2006.01)

(52) U.S. Cl. ..... 123/90.2; 123/90.16; 123/90.39; 123/90.44; 74/569

(58) Field of Classification Search ..... 123/90.16, 123/90.31, 90.2, 90.39, 90.44, 90.45; 74/559, 74/569

See application file for complete search history.

(56) References Cited

U.S. PATENT DOCUMENTS 6,615,782 B1 * 9/2003 Hendriksma et al. .... 123/90.39

* cited by examiner

*Primary Examiner*—Thomas Denion
*Assistant Examiner*—Ching Chang
(74) *Attorney, Agent, or Firm*—Bradley J. Dieorich; L. J. Kasper

(57) ABSTRACT

A valve control system (15) in which there is provided a deactivating rocker arm (51) disposed beneath a conventional, upper rocker arm (27), and disposed within a module housing (17). The deactivating rocker arm includes a latch tab (63) and when the latch tab engages (FIG. 3) a latch member (65), the system operates in a normal, valve activating mode. When the latch member is in an unlatched condition (FIG. 4), the deactivating rocker arm pivots, compressing the valve return spring (41), which thereafter serves as the required lost motion spring, biasing the deactivating rocker arm (51) and lash compensation device (35) back toward their normal position.

6 Claims, 6 Drawing Sheets

VALVE CONTROL SYSTEM INCLUDING DEACTIVATING ROCKER ARM

BACKGROUND OF THE DISCLOSURE

The present invention relates to a valve control system for controlling the engine poppet valves of an internal combustion engine, and more particularly, to a valve control system of the valve deactivation type.

Although the valve control system of the present invention may be utilized to introduce some additional lash into the engine poppet valve train, such that the valves open and close by an amount less than the normal opening and closing, the invention is especially well suited for introducing into the valve train sufficient lash (also referred to hereinafter as "lost motion"), such that the valves no longer open and close at all, and the invention will be described in connection therewith. Vehicle manufacturers wish to be able to incorporate into their engines such valve deactivation capability so that, for example, under light engine load conditions, several of the engine intake poppet valves may be deactivated, thus improving the fuel economy of the vehicle.

Although the valve control system of the present invention may be utilized in various types and configurations of valve gear train, it is especially well suited for use in a valve gear train of the "end pivot rocker arm" type, and will be described in connection therewith by way of example only, and not by way of limitation. In an end pivot rocker arm type of valve gear train, the so-called "end pivot" typically comprises the ball plunger portion of a hydraulic lash adjuster (also referred to hereinafter as an "HLA" or as a "lash compensation device"). A rocker arm has one end thereof pivotally mounted on the ball plunger portion of the HLA, and the opposite end in engagement with the stem tip of the engine poppet valve. Intermediate these opposite ends, the rocker arm includes a cam follower portion in engagement with the cam lobe of a camshaft, all of which is now well known to those skilled in the engine valve train art.

It is also now well known to those skilled in the art to provide valve control systems of the type including "valve deactivation" capability. In one known embodiment of a valve deactivation control system, for an end pivot rocker arm valve gear train, there is provided a hydraulic lash adjuster which includes a moveable latch member. By way of example only, the latch member would typically be operably associated with the cylinder head bore within which the HLA is disposed and with an axially moveable body member of the HLA. Thus, the HLA may be operated in either: (i) a latched condition, in which case the rotation of the camshaft would result in normal valve lift, or (ii) an unlatched condition, introducing lost motion into the valve gear train, whereby rotation of the camshaft would result in very little lift, or more commonly, no lift at all of the respective engine poppet valve.

Such valve deactivation control systems have now started to enjoy a certain amount of commercial success, although the required latching mechanism, and the associated controls, add substantially to the overall cost of the engine valve train. More significantly, the typical prior art valve deactivation system requires a lost motion spring (required to bias the "unlatched" portion of the HLA back toward its normal, latched position). As is well known in the art of such systems, the lost motion in the valve gear train is typically about equal to the maximum valve "lift" (i.e., the linear movement of the engine poppet valve as it opens), thus indicating the size and travel of the required lost motion spring. In addition to the extra expense of providing such a lost motion spring, the presence of a deactivating type of HLA requires substantially more space within the cylinder head, thus complicating the packaging of the overall valve train system.

If the required lost motion spring for use in a deactivating type HLA could be a very small, low force spring, the additional cost of the lost motion spring and the packaging of the deactivating HLA would not comprise a deterrent to the commercialization of such valve deactivation systems. However, as will be understood by those skilled in the art, the lost motion spring must typically be sized (in terms of bias force) such that the lost motion spring will be able to maintain the dynamic stability of the valve gear train, whenever it is operating in the "valve deactivated mode".

BRIEF SUMMARY OF THE INVENTION

Accordingly, it is an object of the present invention to provide an improved valve control system, having valve deactivation capability, which overcomes the above-described disadvantages of the prior art valve deactivation systems.

It is a more specific object of the present invention to provide an improved valve control system which achieves the above-stated object by eliminating the need for a separate lost motion spring to bias the device back toward its "valve activated" mode.

It is a more specific object of the present invention to provide such an improved valve control system which achieves the above-stated objects by utilizing the valve return spring to perform the required lost motion biasing function.

The above and other objects of the invention are accomplished by the provision of an improved valve control system for an internal combustion engine including a cylinder head and an engine poppet valve moveable on a generally vertical direction relative to the cylinder head between a closed position and an open position in response to rotation of a camshaft defining a cam profile having a base circle portion and a lift portion. A first rocker arm includes a cam follower engageable with the cam profile, and defining a valve tip pad at one axial end thereof in engagement with a stem tip portion of the engine poppet valve, and further defining a fulcrum surface at the end axially opposite the valve tip pad. A lash compensation device is fixed relative to the cylinder head for only generally vertical movement relative thereto, and includes a fulcrum portion in engagement with the fulcrum surface of the first rocker arm. A valve return spring has a vertically upper end seated relative to the engine poppet valve and a vertically lower end.

The improved valve control system is characterized by a deactivating rocker arm disposed vertically beneath the first rocker arm and including a pivot location fixed relative to the cylinder head. The deactivating rocker arm has first and second end portions disposed axially opposite the pivot location, the first end portion being fixed vertically relative to the lower end of the valve return spring, and the second end portion being vertically fixed relative to a lower end of the lash compensation device. A latch member is fixed relative to the cylinder head and operably associated with one of the lash compensation device and the second end portion of the deactivating rocker arm. In a latched condition, the latch member prevents substantial vertical movement of the lash compensation device and in an unlatched condition, the latch member permits substantial vertical movement of the second end portion in a downward direction, such that the first rocker arm pivots about the stem tip portion of the engine poppet valve, and permits substantial vertical movement of the first end portion of the deactivating rocker arm in an upward direction, compressing the valve return spring.

DETAILED DESCRIPTION OF THE PREFERRED EMBODIMENT

Figure 1:
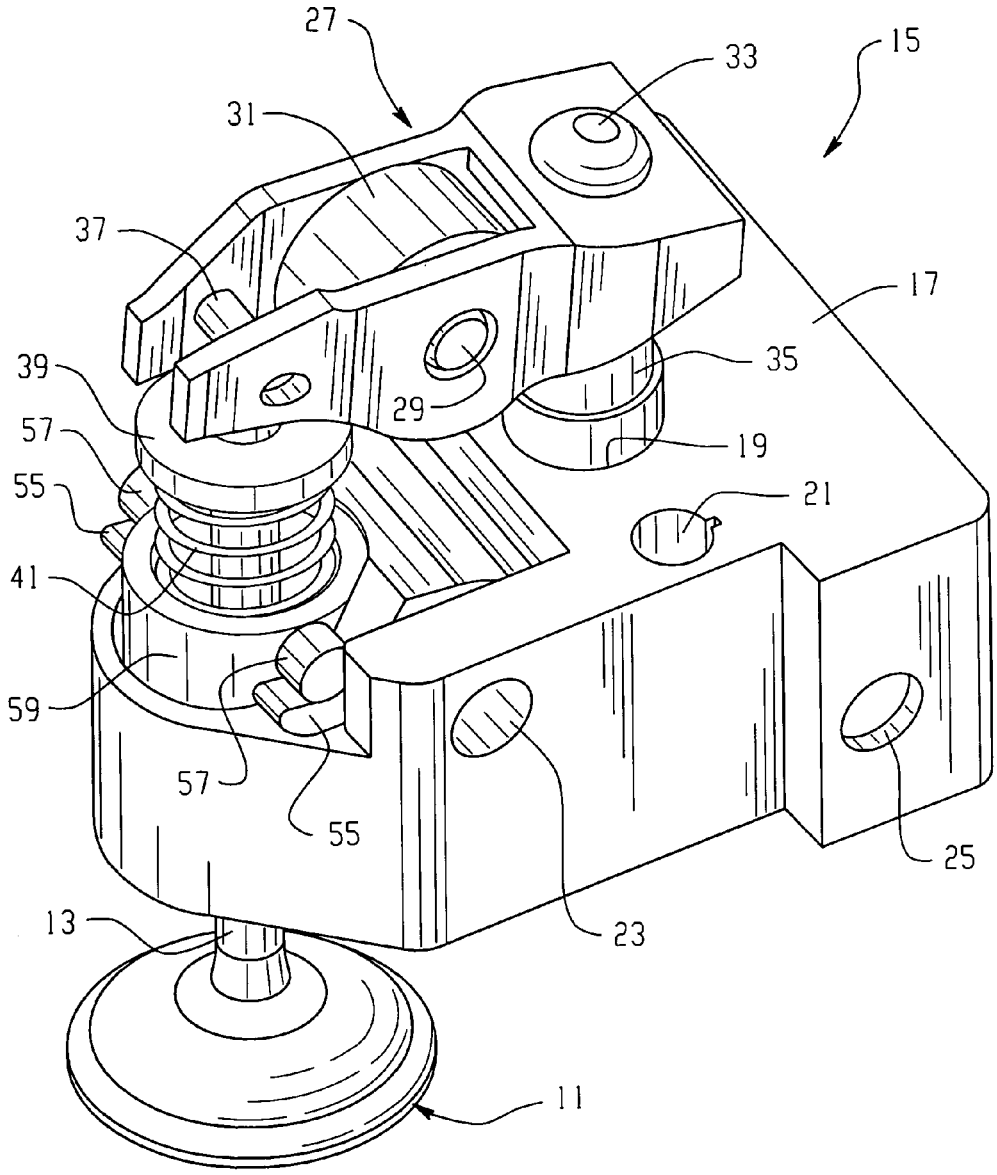
FIG. 1 is a perspective view of a valve deactivation module, made in accordance with the present invention.

Referring now to the drawings, which are not intended to limit the invention, FIG. 1 illustrates a valve control system for controlling an engine poppet valve, generally designated 11 wherein the engine poppet valve includes a valve stem portion 13. It should be clearly understood by those skilled in the art that the present invention is not limited to any particular type or configuration of engine poppet valve, for example, solid as opposed to hollow, forged as opposed to deep drawn, etc.

FIG. 1 illustrates a valve deactivation module, generally designated 15, and it will be understood by those skilled in the art that, typically, the module 15 would be received within a mating, similarly-shaped recess defined by the engine cylinder head (not shown herein). However, it should be understood by those skilled in the art that the practice of the present invention does not require the use of the modular arrangement shown herein. The valve deactivation module 15 comprises a module housing 17 which preferably defines a plurality of bores and openings. Specifically, the module housing 17 defines a large vertical HLA bore 19 and one or more vertical bolt bores 21. It should be understood by those skilled in the art that the term "vertical" is being used herein, and in the appended claims, not by way of limitation, but merely to indicate the likely, general direction, based upon normal engine orientation, and in this case, assuming that the valve stem portion 13 is oriented generally vertically, as might be the case in an inline engine.

The module housing 17 further defines a pair of aligned, transverse bores 23 (only one being shown in FIG. 1) and another transverse bore 25, the function of the bores 23 and 25 to be described subsequently. It should also be understood that, even though the cylinder head is omitted from the drawing figures for simplicity, the module housing 17 is, effectively, part of the cylinder head, and therefore, references hereinafter to an element being fixed or moveable "relative to the cylinder head" will be understood to mean that the recited element is fixed or moveable (as appropriate) relative to the module housing 17.

Figure 2:
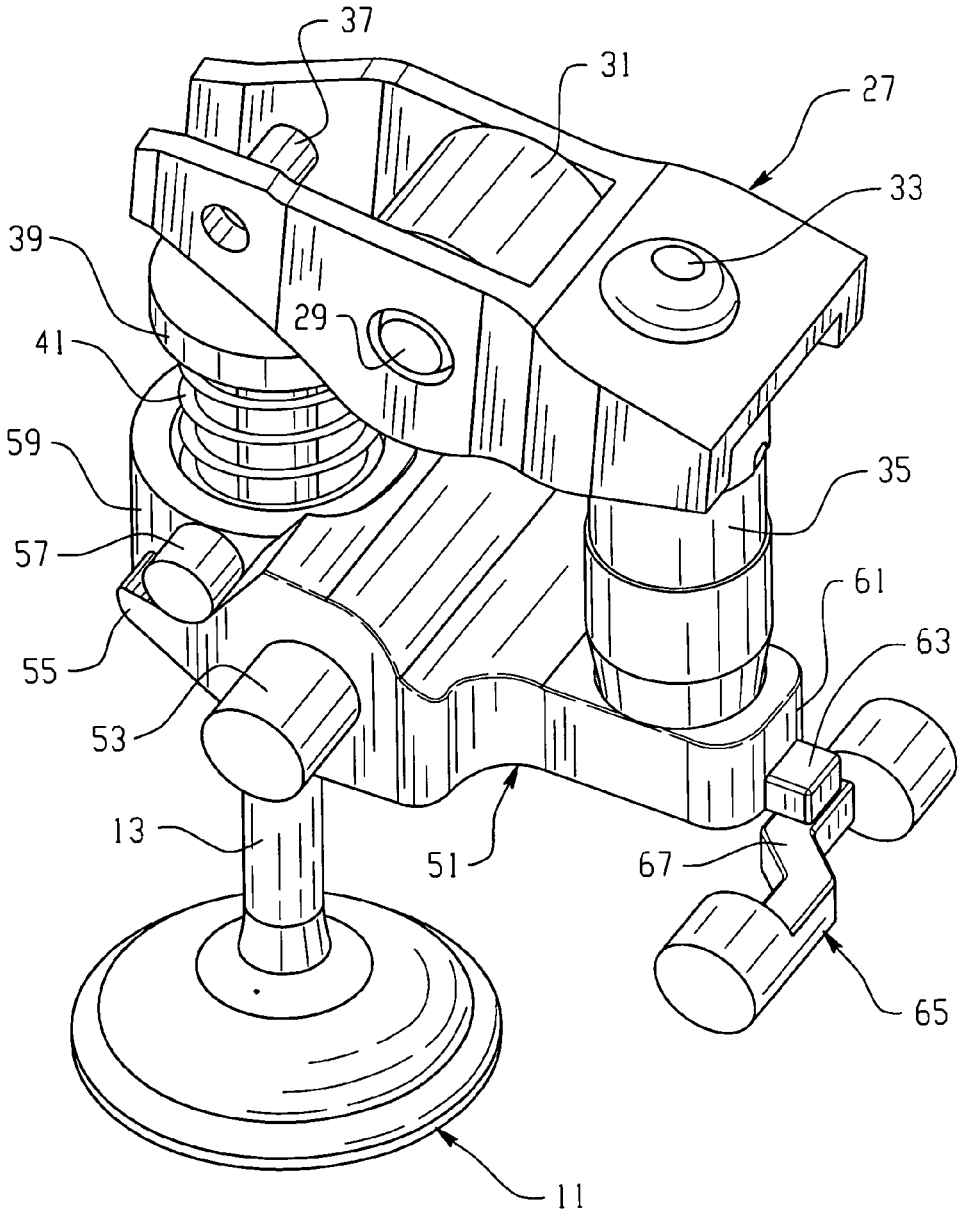
FIG. 2 is a perspective view of the valve deactivation system shown in FIG. 1, but viewed from a different direction, and with the module housing removed to facilitate viewing of the present invention.

Referring still to FIG. 1, but now in conjunction with FIG. 2, the valve deactivation module 15 includes an "upper" rocker arm 27 (referred to in the appended claims as a "first rocker arm"), which may be of any number of well known types and constructions. The upper rocker arm 27, as shown in FIGS. 1 and 2, may comprise a stamped or cast member having opposite side walls supporting a roller shaft 29 on which is rotatably mounted a roller type cam follower 31, although it should be understood that the invention is not limited to use with a roller type cam follower. The upper rocker arm 27 defines a fulcrum surface 33 which (i.e., the underside of what is shown in FIGS. 1 and 2) is configured for engagement with a ball plunger portion (not readily visible herein) of a hydraulic lash adjuster, generally designated 35, in a manner well known to those skilled in the art. Although a hydraulic lash adjuster is preferred for use herein, the invention is not so limited, and any type of lash compensation device may be utilized as the "fulcrum" member or support member for the upper rocker arm 27.

At the opposite axial end of the rocker arm 27, i.e., axially opposite the fulcrum surface 33, is some sort of a valve tip pad portion 37, disposed to engage the tip of the valve stem portion 13, also in a manner well known to those skilled in the art. As the tip of the valve stem is not actually visible in any of the drawing figures, the tip will merely be referred to as "13", the reference numeral designating the valve stem portion. As in the case of the cam follower 31, the valve tip pad portion 37 may take any of the forms well known in the art, and the invention is not limited to any particular form of the portion 37.

Referring now to all of the drawings, disposed toward the upper end of the valve stem portion 13 is a spring retainer 39, fixed relative to the valve stem portion 13 (i.e., fixed against relative movement in the "vertical" direction). Seated against the spring retainer 39 is the upper end of a valve return spring 41. Both the spring retainer 39 and the valve return spring 41 may comprise elements which are already well known and commercially available.

Referring now only to FIGS. 3, 3A, 4 and 4A, there is provided a camshaft 43 which may be of any conventional type and configuration, and may be formed by any of the conventional camshaft forming methods. The camshaft 43 includes a cam lobe having a cam profile including a base circle portion 45 and a lift portion 47, as is well known in the art. Thus, in both FIGS. 3 and 4, the lift portion 47 of the cam profile is in engagement with the cam follower 31, whereas, in both FIGS. 3A and 4A, the base circle portion 45 of the cam profile is in engagement with the cam follower 31.

Referring now primarily to FIGS. 2 through 4A, and in accordance with an important aspect of the invention, there is disposed within the module housing 17 a deactivating rocker arm 51, having a pair of cylindrical posts 53 (only one of which is visible in each of FIGS. 2 through 4A) extending transversely from each side of the deactivating rocker arm 51. Alternatively, a single shaft member could be provided, instead of the separate cylindrical posts, the shaft passing through the rocker arm 51, with the ends thereof being received within the module housing 17. Each of the cylindrical posts (or ends of a single shaft) 53 is received within one of the transverse bores 23 (shown in FIG. 1), such that the bores 23 and the posts 53 cooperate to define a "pivot location" for the deactivating rocker arm 51, that pivot location being fixed relative to the module housing 17, and therefore, relative to the cylinder head, in accordance with the previous explanation. With the valve deactivation module 15 in any of its normal orientations relative to the cylinder head, the deactivating rocker arm 51 will be disposed "vertically beneath" the upper rocker arm 27, for reasons which will become apparent subsequently.

The deactivating rocker arm 51 has a first end portion 55 (typically, a pair of end portions 55, only one of which shows in most of the drawings). Seated against an upper surface of each of the first end portions 55 is a cylindrical support member 57, the support members 57 being formed on diametrically opposite sides of a spring seat member 59. The spring seat member 59 is formed in a generally cup-shaped configuration, but with the bottom portion defining an opening to accommodate the valve stem portion 13, such that the spring seat member 59 serves as a seat for the lower end of the valve return spring 41.

The deactivating rocker arm 51 also includes a second end portion 61, and as may best be seen in FIG. 2, the upper surface of the second end portion 61 serves as a seat for the lower end of the hydraulic lash adjuster 35, such that the second end portion 61 is intended to remain in a fixed relationship, in regard to movement vertically, relative to the lower end of the HLA 35. Preferably, the upper surface of the second end portion 61 is provided with some sort of contact pad, which is in engagement with a bottom end surface of the outer body of the HLA 35, thus permitting relative sliding motion of the HLA outer body and the upper surface of the second end portion 61 during the movement between the valve activating and deactivating modes, which will be described further hereinafter.

Extending axially from the second end portion 61 of the deactivating rocker arm 51 is a latch tab 63, shown herein by way of example only. As may best be seen in FIG. 2, disposed adjacent the latch tab 63 is a moveable latch member, generally designated 65, the function of which is, selectively, either (a) to engage the latch tab 63; or (b) not to engage the latch tab 63, as will be described in greater detail subsequently. In the subject embodiment, and by way of example only, the latch member 65 is disposed within the transverse bore 25 shown in FIG. 1 and would be biased by means of a spring (not shown herein) to the position shown in FIG. 2 (the "latched" condition). The latch member 65 would be biased by fluid pressure introduced into the transverse bore 25 (from the end visible in FIG. 1) to move the latch member 65 to a position (upward and to the right on the plane of the drawing in FIG. 2) in which the latch tab 63 is no longer in engagement with a latch portion 67.

It should be understood by those skilled in the art that, within the scope of the present invention, any one of a number of well known latching arrangements may be utilized. For example, although the latching arrangement shown herein is between a latch member and the deactivating rocker arm 51, it would also be possible, within the scope of the invention, to have the latching arrangement be between a moveable latch member and some portion of the lash compensation device (HLA 35). Furthermore, although the latching arrangement shown herein involves transverse movement of the latch member 65, the movement between the latched and unlatched conditions could also be accomplished by movement of a latch member along the axis of the deactivating rocker arm 51. Various other arrangements for the latching will also occur to those skilled in the art (which could be hydraulic, mechanical, electromagnetic, etc.), and it is intended that all such alternative latching arrangements be included within the scope of the claims.

Figure 3:
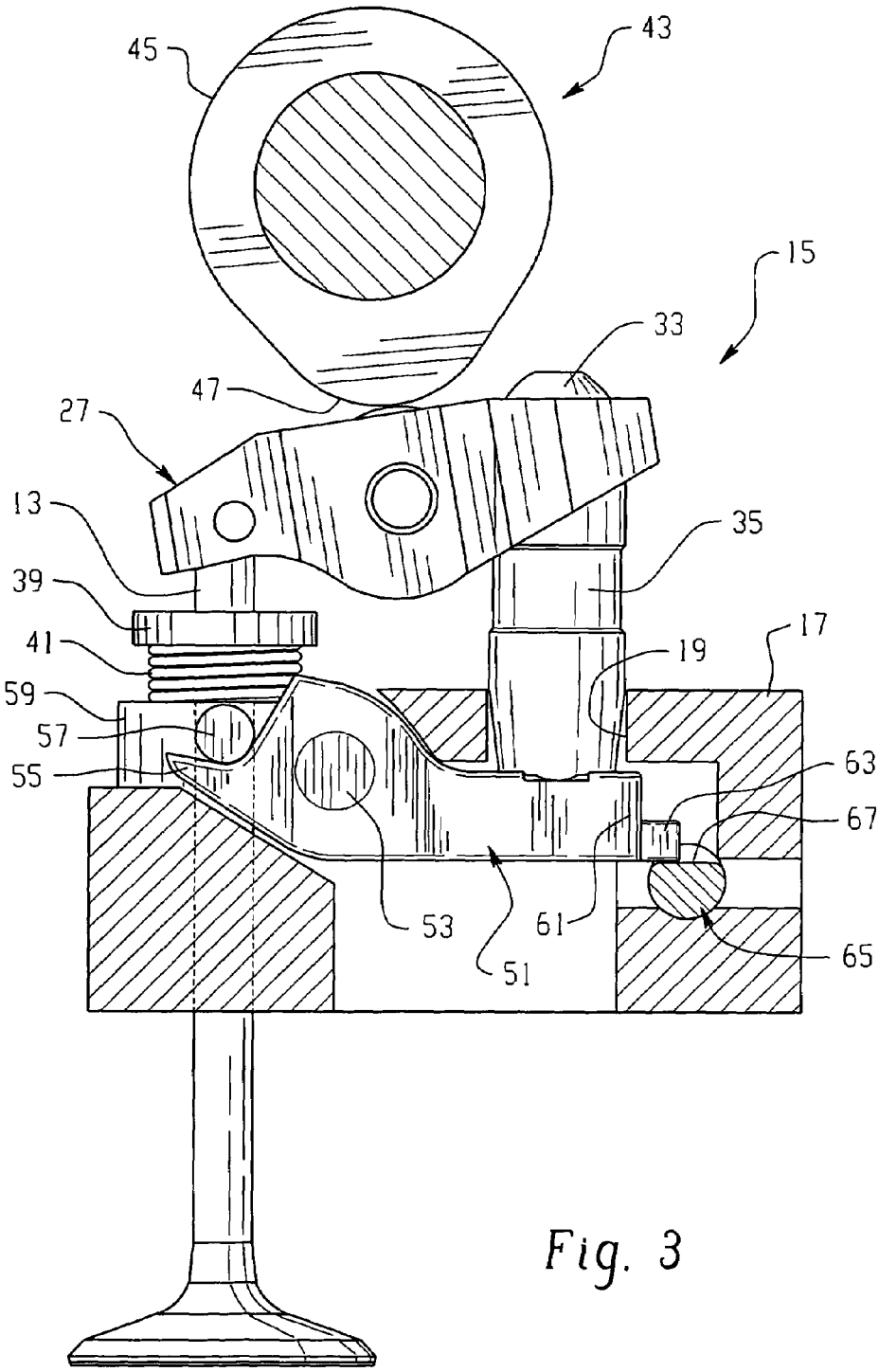
FIGS. 3 and 3A are axial cross-sections of the valve control system of the present invention in its normal, valve activated mode, showing the lift and base circle conditions, respectively.
Figure 3A:
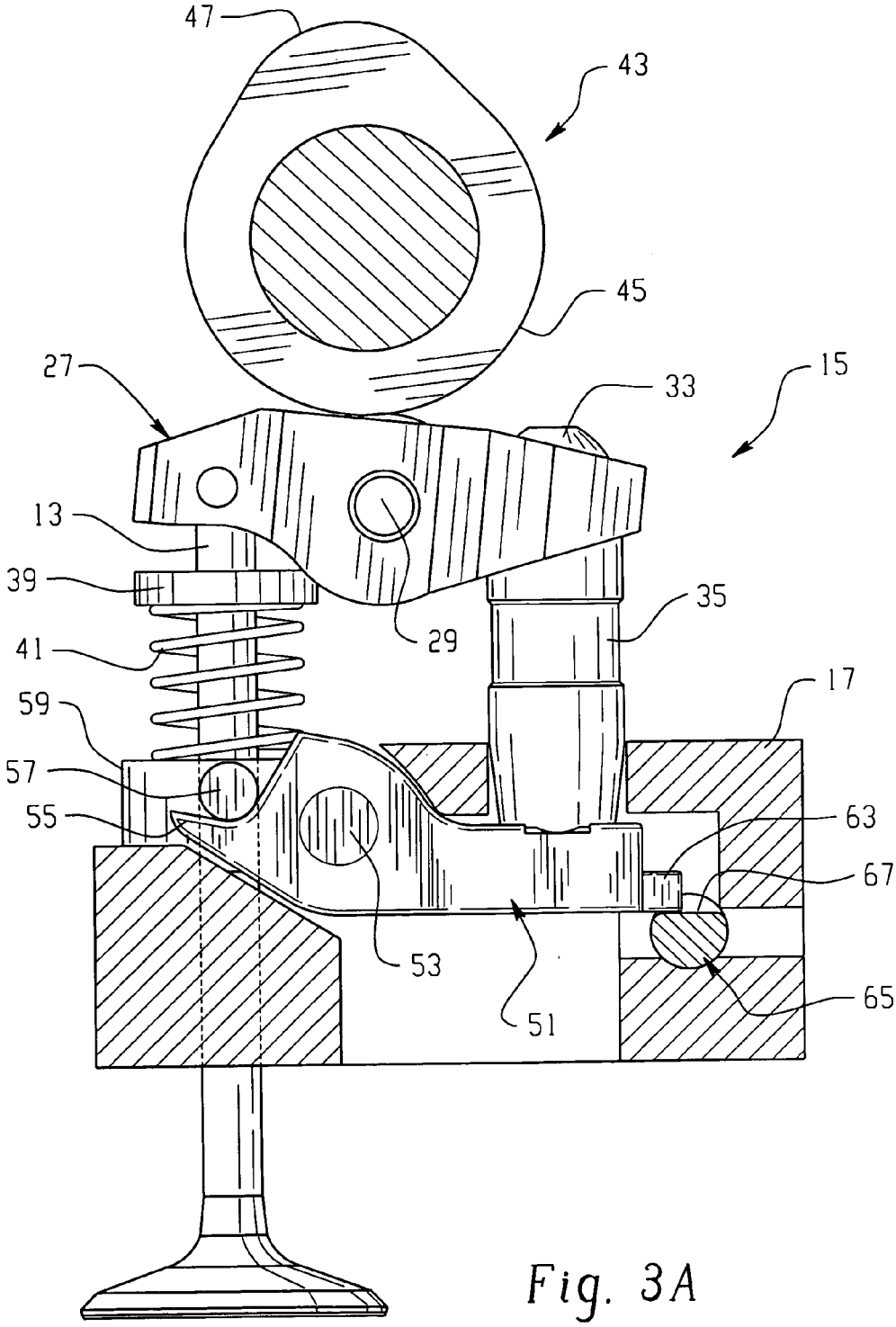

When it is desired to operate the valve deactivation module 15 in the "valve activated mode", the latch member 65 is moved to the latched condition shown in FIGS. 2 and 3, with the latch tab 63 engaging the latch portion 67. In the latched condition, with the cylindrical posts 53 being fixed relative to the module housing 17, and the latch tab 63 being held in a "fixed" position by the latch member 65, it should be apparent that there is no substantial movement of the deactivating rocker arm 51. Therefore, the spring seat member 59 remains in the position shown in FIG. 3, providing a "fixed" seat for the lower end of the valve return spring 41. At the same time, the second end portion 61 of the deactivating rocker arm 51 provides a vertically "fixed" seat for the HLA 35 (in much the same manner as if the HLA were disposed within a bore in the cylinder head), so that the ball plunger portion of the HLA 35 acts as a true fulcrum, about which the upper rocker arm 27 pivots In this latched condition as described above, when the lift portion 47 of the cam profile engages the cam follower 31, there is no substantial downward movement of the ball plunger portion of the hydraulic lash adjuster 35 (only a small amount of "lash compensation" movement). Therefore, with the HLA 35 effectively providing a "fixed" fulcrum location for the upper rocker arm 27, the lift portion 47 of the cam profile causes the upper rocker arm 27 to pivot in the manner represented in FIG. 3, from the "base circle" condition shown in FIG. 3A, moving the engine poppet valve 11 downward from the closed position shown in FIG. 4 toward the open position represented in FIG. 3. This downward movement of the engine poppet valve 11 is in opposition to the biasing force of the valve return spring 41, in a generally conventional manner, because the spring seat member 59 remains fixed vertically in view of the fact that the deactivating rocker arm 51 is latched and cannot pivot about the cylindrical posts 53.

Figure 4:
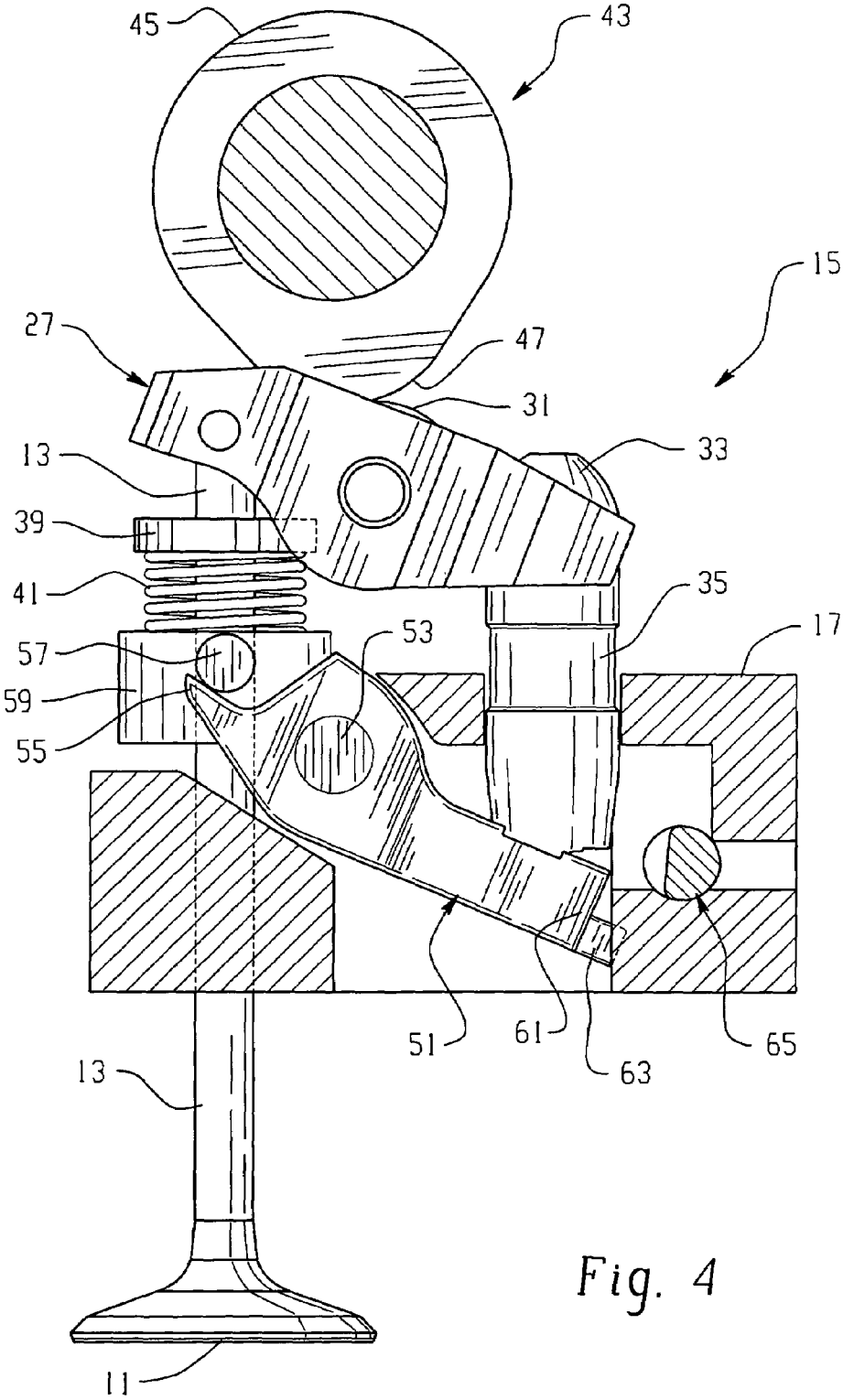
FIGS. 4 and 4A are an axial cross-sections, similar to FIG. 3, illustrating the valve deactivation system of the present invention in its valve deactivated mode, again showing the lift and base circle conditions, respectively.

When it is desired to operate the valve deactivation module 15 in a "valve deactivated mode", the latch member 65 is moved from the position shown in FIG. 2 to the unlatched condition in which it no longer engages and prevents downward movement of the latch tab 63. Therefore, the valve deactivation module 15 is now able to operate in the unlatched condition shown in FIG. 4. With the second end portion 61 of the deactivating rocker arm 51 now being free to move downward, the first end portion 55 is forced to move upward, forcing the support members 57 and the spring seat member 59 upward, compressing the valve return spring 41 against the spring retainer 39. As will be understood, because the engine poppet valve 11, as shown in FIG. 4, is in the closed position, seated against its valve seat insert (not shown herein), the spring retainer 39 is "fixed" in the vertical direction by its attachment to the upper end of the valve stem portion 13. As a result, after the lift portion 47 of the cam profile has moved out of engagement with the cam follower 31, such that the cam follower 31 is then in engagement with the base circle portion 45 (see FIG. 4A). The valve return spring 41 now functions as the "lost motion" spring for the deactivating rocker arm 51 and the HLA 35, biasing the HLA 35 upward, and biasing the upper rocker arm 27 upward to the position shown in FIG. 4A to maintain the cam follower 31 in engagement with the cam profile.

Figure 4A:
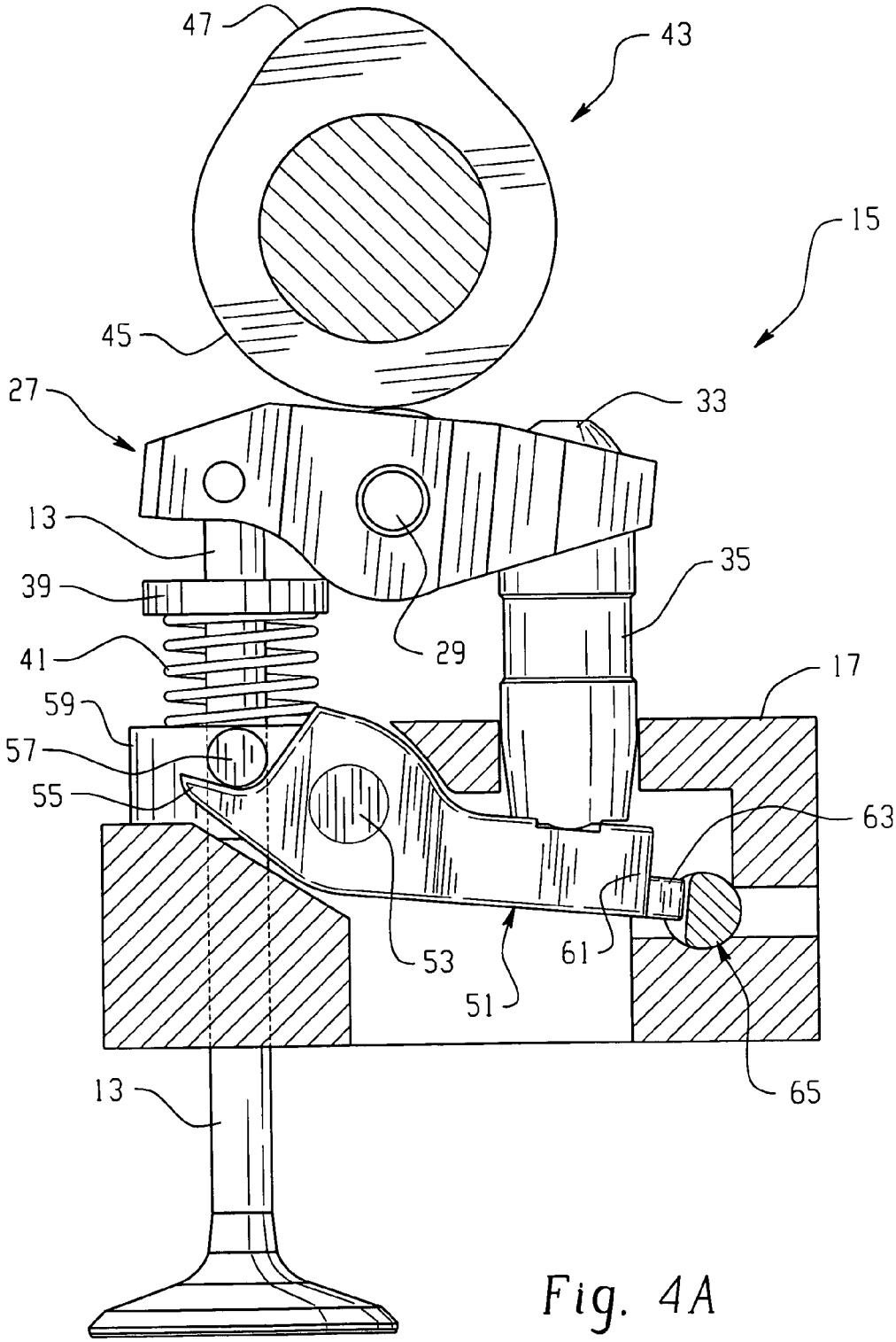

With the valve deactivation module 15 in the unlatched condition shown in FIG. 4, but now operating "on the base circle" as shown in FIG. 4A, the spring 41 biases the spring seat member 59 downward, and the corresponding force of the support members 57 on the first end portions 55 causes the deactivating rocker arm 51 to pivot about the cylindrical posts 53, moving the second end portion 61 and the HLA 35 in an upward direction. Such upward movement of the HLA 35 causes the upper rocker arm 27 to again pivot, but this time, with the pivot point being the engagement of the valve tip pad portion 37 on the valve stem portion 13. Thus, the upper rocker arm 27 is returned to its normal, unactuated position and the deactivating rocker arm 51 is returned to its position as shown in FIGS. 2 and 3 in which, if desired, the latching arrangement may again be engaged, for operation in the valve activated mode.

It will be seen that there is a ratio between the distance from the axis of the cylindrical posts 53 to the engagement of the first end portion 55 and the support members 57, and the distance from the axis of the posts 53 to the engagement of the second end portion 61 and the HLA 35. In the subject embodiment, that ratio is about 1.0:1.5, and the significance is that the ratio must be selected, relative to the force of the valve return spring 41, to provide a force upward on the HLA 35 equal to the force which would be exerted by a lost motion spring, if one were present. At the same time, the configuration of the upper rocker arm 27 must be selected such that, in the valve deactivated mode, when the lift portion 47 engages the cam follower 31, the HLA 35 moves downward, rather than the engine poppet valve 11 moving downward. Thus, the second end portion 61 must be further from the posts 53 than the first end portion 55. It is believed to be within the ability of those skilled in the art, from a reading and understanding of the foregoing specification, to make appropriate selections of the various dimensions, ratios, spring force, etc.

Preferably, and in accordance with one further aspect of the invention, the entire valve deactivation module 15 is assembled, tested, and shipped to the engine assembly plant, for assembly into the cylinder head. Typically, but by way of example only, the valve deactivation module 15 which is shipped to the engine assembly plant would not include the engine poppet valve 11 or the spring retainer 39, or valve return spring 41. After the module housing 17 is installed within the cylinder head, the engine poppet valve 11 would be installed from the fire-deck (combustion) side of the cylinder head, up through the valve guide and valve stem seal (not shown herein), and through the opening in the spring seat member 59. The valve return spring 41 and the spring retainer 39 would then be installed, and finally, the upper rocker arm 27 would be set in position engaging the fulcrum portion of the HLA 35 and the tip of the valve stem portion 13.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve control system for an internal combustion engine including a cylinder head, and an engine poppet valve moveable in a generally vertical direction relative to said cylinder head between closed and open positions in response to rotation of a camshaft defining a cam profile having a base circle portion and a lift portion; a first rocker arm including a cam follower engageable with said cam profile, and defining a valve tip pad at one axial end thereof in engagement with a stem tip portion of said engine poppet valve, and further defining a fulcrum surface at the end axially opposite said valve tip pad; a lash compensation device fixed relative to said cylinder head for only generally vertical movement relative thereto, and including a fulcrum portion in engagement with said fulcrum surface of said first rocker arm; a valve return spring having a vertically upper end seated relative to said engine poppet valve and a vertically lower end; said valve control system being characterized by:

(a) a deactivating rocker arm disposed vertically beneath said first rocker arm and including a pivot location fixed relative to said cylinder head;

(b) said deactivating rocker arm having first and second end portions disposed axially opposite said pivot location, said first end portion being fixed vertically relative to said lower end of said valve return spring, and said second end portion being vertically fixed relative to a lower end of said lash compensation device; and (c) a latch member fixed relative to said cylinder head and operably associated with said one of said lash compensation device and said second end portion of said deactivating rocker arm whereby:

(i) in a latched condition, said latch member prevents substantial vertical movement of said lash compensation device, and (ii) in an unlatched condition, said latch member permits substantial vertical movement of said second end portion in a downward direction, such that said first rocker arm pivots about said stem tip portion of said engine poppet valve, and permits substantial vertical movement of said first end portion of said deactivating rocker arm in an upward direction, compressing said valve return spring.

2. A valve control system as claimed in claim 1, characterized by said valve return spring, when said latch member is in said unlatched condition, serving as a lost motion spring for said deactivating rocker arm and said lash compensation device.

3. A valve control system as claimed in claim 1, characterized by said cylinder head defining a recess, and said valve control system including a module housing adapted to be disposed within said recess, said module housing defining a generally vertical bore, said lash compensation device being reciprocably disposed within said vertical bore.

4. A valve control system as claimed in claim 3, characterized by said pivot location of said deactivating rocker arm comprising a member fixed relative to said module housing, said deactivating rocker arm being disposed within said module housing, and said latch member being disposed within said module housing and fixed for movement relative thereto only between said latched condition and said unlatched condition.

5. A valve control system as claimed in claim 1, characterized by said valve return spring having a seat member operably associated with said vertically lower end of said valve return spring, said seat member including a portion thereof in engagement with said first end portion of said deactivating rocker arm, whereby, movement of said first end portion in a vertically upward direction moves said seat member vertically, compressing said valve return spring.

6. A valve control system as claimed in claim 5, characterized by said deactivating rocker arm being configured such that the distance from said pivot location to said second end portion is greater than the distance from said pivot location to said first end portion, whereby, in said unlatched condition, engagement of said lift portion and said cam follower forces said lash compensation device downward, but does not force said engine poppet valve downward.

* * * * *